United States Patent [19]

Papastavros

[11] Patent Number: 4,733,537

[45] Date of Patent: Mar. 29, 1988

[54] TURBINE POWER PLANT WITH STEAM AND EXHAUST TURBINE SYSTEMS

[76] Inventor: Demos Papastavros, 2429 NE. 184th Ter., N. Miami Beach, Fla. 33160

[21] Appl. No.: 148

[22] Filed: Jan. 2, 1987

Related U.S. Application Data

[63] Continuation-in-part of Ser. No. 710,708, Mar. 11, 1985, abandoned.

[51] Int. Cl.[4] ..... F01K 23/04

[52] U.S. Cl. ..... 60/655; 60/669; 60/693

[58] Field of Search ..... 60/655, 669, 676, 691, 60/693

[56] References Cited

U.S. PATENT DOCUMENTS

| | | | |
|---|---|---|---|
| 4,041,709 | 8/1977 | Rajakovics | 60/671 X |
| 4,165,614 | 8/1979 | Yeh | 60/670 X |
| 4,228,657 | 10/1980 | Leo | 60/670 X |
| 4,422,298 | 12/1983 | Nozawa | 60/655 |
| 4,503,682 | 3/1985 | Rosenblatt | 60/655 X |
| 4,571,949 | 2/1986 | Moke | 60/655 |

FOREIGN PATENT DOCUMENTS

| | | | |
|---|---|---|---|
| 883528 | 11/1981 | U.S.S.R. | 60/655 |

*Primary Examiner*—William R. Cline
*Assistant Examiner*—Peggy Neils

[57] ABSTRACT

A turbine power plant consisting of a closed loop steam turbine system and a closed loop exhaust turbine system. An external fuel source is used to drive the steam turbine system. The heat energy of the hot exhaust fluid of the steam turbine system is transferred to the exhaust turbine system, therefore driving the exhaust turbine system. The turbines used in this invention are designed to allow a heat exchange relationship between the closed loop cycle of the steam turbine system and the closed loop cycles of the exhaust turbine system. In the closed loop steam turbine system, the hot exhaust fluid of the steam turbine system flows through a conduit where it gives up heat energy to the turbines of the exhaust turbine system, prior to reaching a condenser. The working fluid, now in a liquid phase, flows through a pump and then collects heat energy from the exhaust fluid of the turbines in the exhaust turbine system, preheating the working fluid prior to reaching a heater and the steam turbine. In each of the closed loop cycles of the exhaust turbine system heat energy from the steam turbine system is used to drive the exhaust turbine. The exhaust fluid of the exhaust turbine is cooled by the steam turbine system, then the working fluid flows through the first fluid passageway of the heat exchanger and then through a condenser where the working fluid changes phase to a liquid. The working fluid now flows through a pump, through the second passageway of the heat exchanger where it is preheated; receives additional heat energy from the steam turbine system and then enters the exhaust turbine.

5 Claims, 3 Drawing Figures

TURBINE POWER PLANT WITH STEAM AND EXHAUST TURBINE SYSTEMS

CROSS REFERENCE TO RELATED APPLICATIONS

This application is a continuation-in-part of my copending U.S. patent application Ser. No. 710,708, filed Mar. 11, 1985 now abandoned.

SUMMARY OF THE INVENTION

This invention has similar characteristics as those in U.S. Pat. Nos. 4,378,678 (Turbine System), 4,502,277 (Turbine Power Plant System), and 4,420,941 (Cooling System). If desired, the turbine in this invention can be used in each of the those system, in close loop and open loop cycles.

This invention relates to an energy producing system which consists of a closed loop steam turbine system and a closed loop exhaust turbine system to generate electricity.

A principal objective of this invention is to provide a novel energy producing system having turbines, heater, heat exchangers, condensers, and pumps arranged in a novel manner for improved efficiency, minimum energy consumption, and less pollution. One method of improving efficiency is the recycling of energy from hot exhaust fluid and the saving of fuel needed by the heater or vapor generator (ie. feed heating).

Another objective of this invention is to provide a novel energy producing system which allows a heat exchange relationship between two or more closed loop cycles. A closed loop steam turbine system allows heat energy to be transferred to a closed loop exhaust turbine system and vise versa. The exhaust turbine system may be modified to be connected to any conventional turbine system and it can modified to use any heat source for the production of energy.

Another objective of this invention is to provide a system the turbine blades of the turbine are set at an angle in the rotor passageway which allows them to pull in working fluid at the turbine inlet and push out working fluid at the turbine outlet. Therefore a pump may not be needed to feed the heater or vapor generator (i.e. feed heating).

Further objects and advantages of this invention will be apparent from the following detailed description of a presently preferred embodiment, which is shown schematically in the accompanying drawing.

Before explaining the disclosed embodiment of the present invention in detail it is to be understood that the invention is not limited in its application to the details of the particular arrangement shown since the invention is capable of other embodiments. Also, the terminology used herein is for the purpose of description and not limitation.

DETAILED DESCRIPTION

Figure 1:
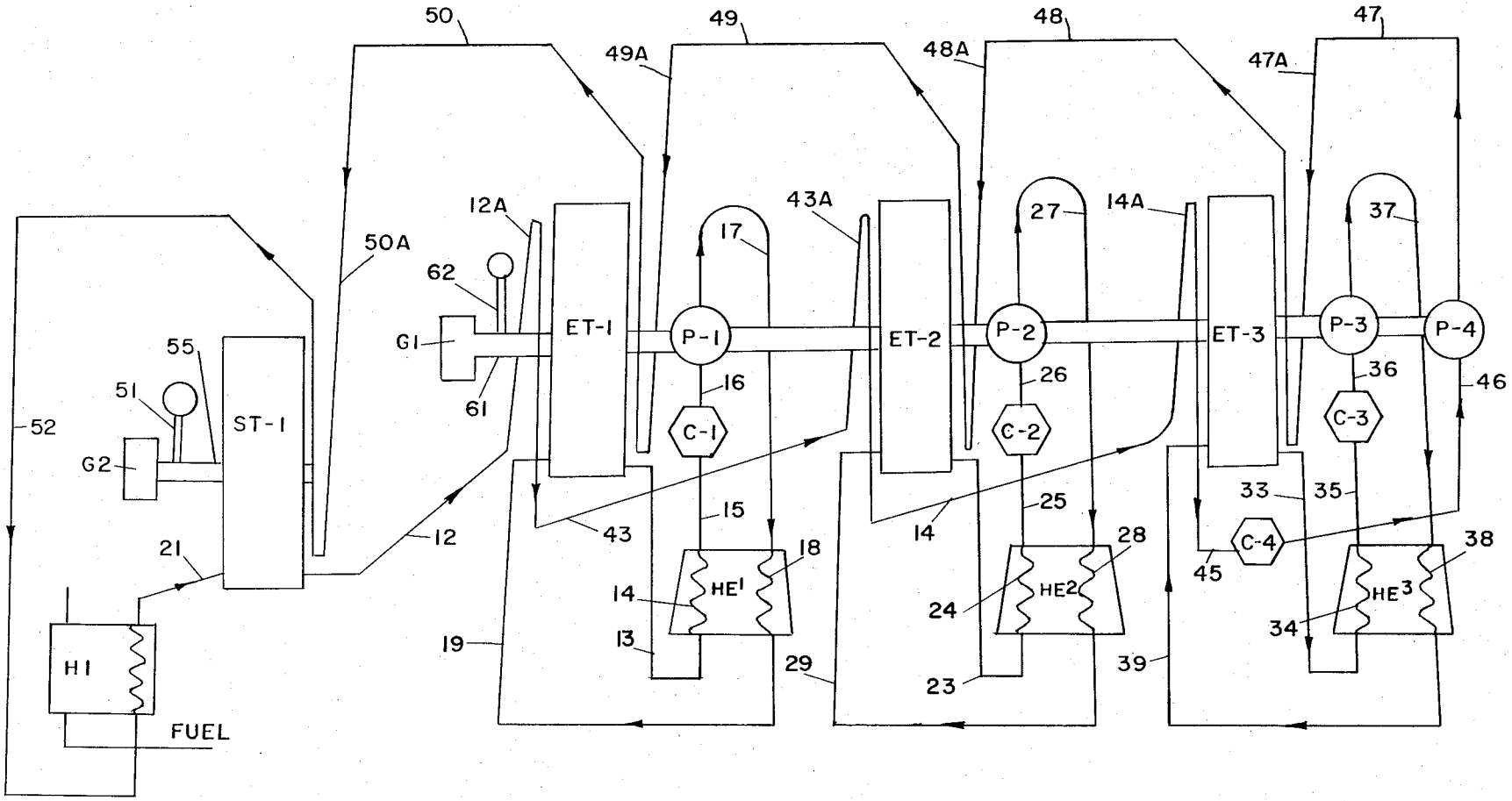
FIG. 1 shows schematically the turbine power plant consisting of the closed loop steam turbine system and the closed loop exhaust turbine system.

FIG. 1 represents the turbine power plant which consists of a closed loop steam turbine system and a closed loop exhaust turbine system.

The closed loop steam turbine system consists of a steam turbine ST-1, mounted on shaft 55, along with generator G-2 and starter 51. The working fluid enters heater H-1 which uses an external fuel source to "superheat" the fluid. The "superheated" working fluid flows through conduit 21 to steam turbine ST-1 where energy is produced and collected by generator G-2. The hot exhaust fluid from steam turbine ST-1 flows through conduit 12 to conduit 12A where heat energy is transferred to exhaust turbine ET-1 through a heat exchange relationship. The hot exhaust fluid from steam turbine ST-1, having given up a portion of its heat energy to exhaust turbine ET-1, now flows through conduit 43 to conduit 43A where some heat energy is transferred to exhaust turbine ET-2 through a heat exchange relationship. The hot exhaust fluid then flows through conduit 14 to conduit 14A where some heat energy is transferred through a heat exchange relationship to exhaust turbine ET-3. Therefore, the heat energy required to operate the three exhaust turbines is obtained from the hot exhaust of steam turbine ST-1.

The closed loop exhaust turbine system consists of three individual closed loop cycles which have three exhaust turbines, ET-1, ET-2 and ET-3, each mounted on a common shaft 61, along with generator G-1 and starter 62.

The exhaust fluid then flows through conduit 45 to condenser C-4 where the remaining heat is given up to the environment. The working fluid is condensed to a liquid phase at condenser C-4. The working fluid now flows through conduit 46 to pump P-4 which is used to circulate the fluid through the closed loop cycle.

The working fluid which has been cooled significantly and is in a liquid phase, then flows through conduit 47 to 47A where it absorbs heat energy from the exhaust fluid of exhaust turbine ET-3 through a heat exchange relationship. The working fluid now flows through conduit 48 to conduit 48A repeating the same process and absorbing heat energy from the exhaust fluid of exhaust turbine ET-2. Conduit 49 now carries the working fluid to conduit 49A where additional heat energy is absorbed from the exhausted fluid of exhaust turbine ET-1 through a heat exchange relationship. The working fluid now flows through conduit 50 to conduit 50A where it absorbs heat energy from the exhaust of steam turbine ST-1 through a heat exchange relationship. The working fluid, which has been preheated by the exhaust fluid of turbines ET-3, ET-2, ET-1 and ST-1, now flows through conduit 52 to heater H-1 where additional heat energy is added to the system by an external fuel source. This represents a complete cycle of the steam turbine system.

In the first closed loop cycle, the working fluid flows into exhaust turbine ET-1 where energy is produced and collected by generator G-1. The exhaust fluid of exhaust turbine ET-1 gives off heat energy to conduit 49A of the steam turbine system before it flows through conduit 13 to the first fluid passageway arrangement 14 of heat exchanger HE-1. The working fluid now flows through conduit 15 to condenser C-1, where any remaining heat is given off to the environment. Conduit 16 then carries the working fluid to pump P-1 which is used to circulate the fluid through the closed loop cycle. The working fluid then flows through conduit 17 to the second fluid passageway arrangement 18 of heat exchanger HE-1 where it is preheated by the heat energy flowing in the opposite direction in the first passageway arrangement 14. This preheated fluid now flows through conduit 19, where it receives additional heat energy from conduit 12A of the steam turbine system, before it enters exhaust turbine ET-1. The working fluid changes phase to a liquid in condenser C-1. This represents a complete cycle of the first closed loop of the exhaust turbine system.

The closed loop cycles of exhaust turbines ET-2 and ET-3 operate in the same manner as the closed loop cycle of exhaust turbine ET-1. In the second closed loop cycle, the working fluid flows through turbine ET-2. The exhaust of ET-2 gives off some heat energy to conduit 48A of the steam turbine system before it flows through conduit 23. The working fluid then flows through the first passageway arrangement 24 of heat exchanger HE-2, conduit 25, condenser C-2, conduit 26, pump P-2, conduit 27, the second passageway arrangement 28 of heat exchanger HE-2 and then the preheated working fluid flows through conduit 29, where it receives heat energy from conduit 43A of the steam turbine system, to the inlet of turbine ET-2, therefore completing the closed loop cycle.

In the third closed loop cycle, the working fluid recieves heat energy from conduit 14A of the steam turbine system, then flows through turbine ET-3 and gives off heat energy to conduit 47A of the steam turbine system before it flows through conduit 33. The working fluid than flows through the first fluid passageway arrangement 34 of heat exchanger HE-3, conduit 35, condenser C-3, conduit 36, pump P-3, conduit 37, the second passageway arrangement 38 of heat exchanger HE-3 and then through conduit 39 to the inlet of turbine ET-3, therefore completing the closed loop cycle.

Figure 2:
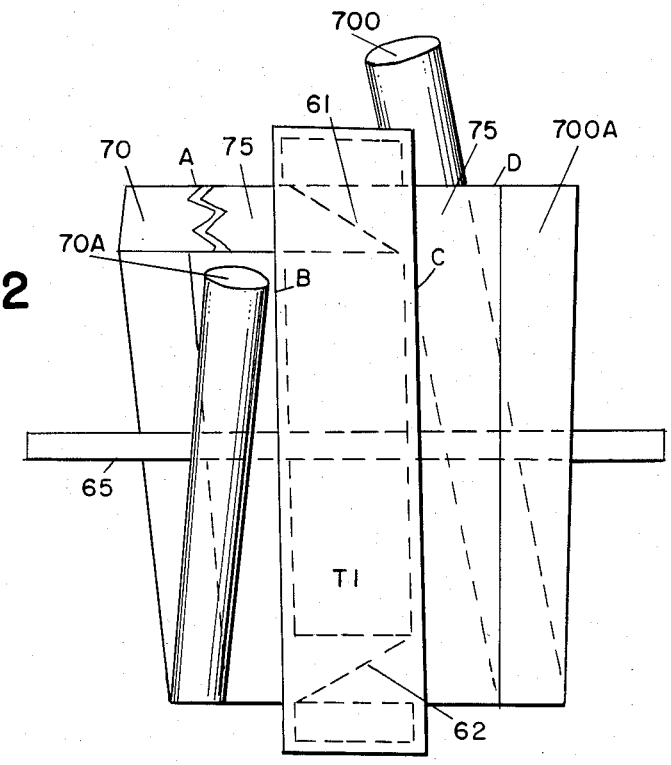
FIG. 2 shows schematically a side view of the turbines used in the turbine power plant.

FIG. 2 shows schematically a side view of the turbines used in the turbine power plant. The turbines have an apparatus that allows for a heat exchange relationship between the working fluid flowing through the closed loop cycle of the turbine and the working fluid of another closed loop cycle. Only heat energy is exchanged, the fluids of the two cycles do not mix.

Referring to FIG. 2, on the inlet side of turbine T-1, conduit 75 contains the working fluid which will enter turbine T-1. Conduit 70 contains hot exhaust fluid from the steam turbine closed loop cycle. As the fluid in conduits 70 and 75 flow in the same clockwise direction, from point A to point B, heat energy is transferred from conduit 70 to conduit 75. This heat energy is used to drive turbine T-1. Conduit 75 "tapers in" decreasing in size from point A to point B and it distributes heat energy to all the rotor blades, hitting the blades continuously, as it flows clockwise from point A to point B. Number 70 represents the inlet and 70A represents the outlet of the same conduit.

On the outlet side of turbine T-1, conduit 75A contains the hot exhaust fluid of turbine T-1. Conduit 700 contains cool fluid coming from a condenser in the steam turbine closed loop cycle. As the fluid in conduits 75A and 700 flow in a clockwise direction, from points C to D, the cool fluid in conduit 700 receives heat energy from the hot exhaust fluid flowing in conduit 75A. This heat energy is used to preheat the fluid flowing to the turbine in the steam turbine closed loop cycle. Conduit 75A "tapers out", increasing in size, from point C to point D, and it cools the working fluid, which leaves the blades continuously, as it flows clockwise from point C to point D. Number 700 represents the inlet and 700A represents the outlet of the same conduit.

Other systems can be designed with the aforementioned principal where conduit 70 carries fluid with heat energy from any source. FIG. 2 also shows shaft 65 and turbine blades 62 and 61.

Figure 3:
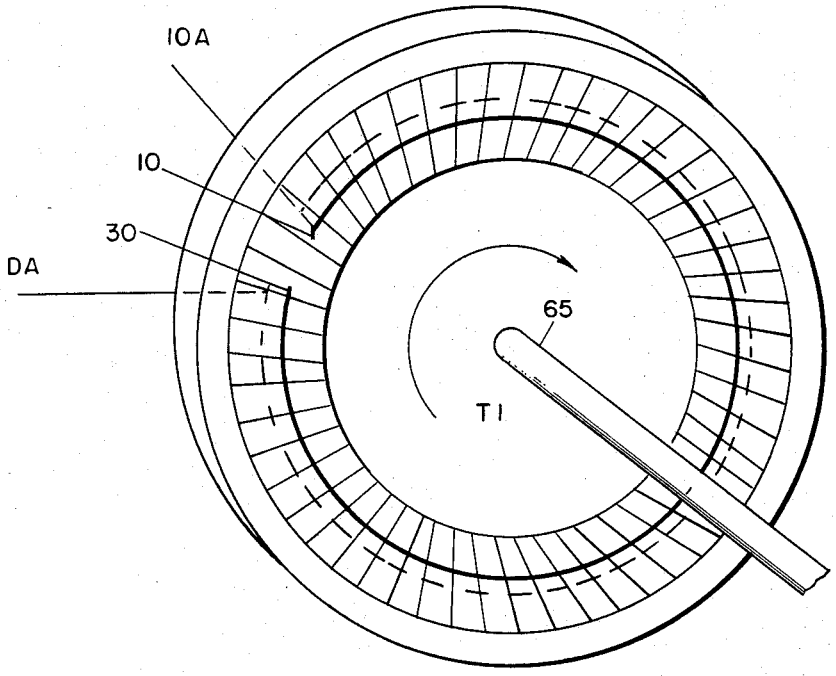
FIG. 3 shows schematically a side view of the turbine rotor, rotor blades and shaft.

FIG. 3 shows schematically the interior of turbine T-1 in FIG. 2 with the rotor, rotor blades and shaft. The working fluid enters the blades at point 10 and leaves at point 10A. The rotor blades are continuously hit by the working fluid as they rotate clockwise from point 10 to point 30. The working fluid continuously leaves the rotor blade passageway as the rotor blades rotate clockwise from point 10A to point 30A.

This system can be modified to allow the exhaust turbine system to receive heat energy from conventional gas turbines or any other heat source. This is accomplished by removing the components of the steam turbine system from the outlet of conduit 45 to the inlet of conduit 12. In their place, add a conventional gas turbine system whose hot exhaust flows into conduit 12 and escapes into the environment at the outlet of conduit 45. This system can also be modified to allow the exhaust turbine system to receive heat energy from a conventional steam turbine system. This can be accomplished by removing heater H-1 of the steam turbine system. A conventional steam turbine would be mounted on shaft 55 along with steam turbine ST-1. Conduit 52 would carry working fluid to the heater of the conventional steam turbine. The working fluid would then flow into the conventional steam turbine and the exhaust fluid would be connected to conduit 21 of the steam turbine system.

Another possible modification to this invention would be to convert the closed loop steam turbine cycle to an open loop cycle. This is accomplished by eliminating conduit 46 and replacing the heater with a boiler. Working fluid would flow from the outlet of condenser C-4 to the environment. Pump P-4 would bring working fluid into the system (in liquid form) from the environment. This working fluid would flow through conduit 47 and be preheated before entering the boiler. The working fluid would enter the boiler as a liquid, therefore the system would be modified where the fluid could bypass conduits 48A,49A and 50A depending on how much preheating is necessary. A holding tank is attached to the boiler by use of a conduit. The holding tank has valves on both sides of its inlet and outlet. The system can now be used for the distillation of water without the use of additional energy as the turbine power plant is producing electricity. The holding tank is used to rid the boiler of residues remaining in the distillation process.

This section has described the operation of the turbine power plant as shown in FIG. 1, however the same principles described herein can be applied to other cycles. A new closed turbine system can be developed by using any combination of the closed loop exhaust turbines as specified in this application and modifying them/it by using an external fuel source instead of having it attached to the closed loop steam turbine system. Also, in its present form, this invention can use any number of closed loop exhaust turbine cycles, as the need arises.

The turbine power plant can use different working fluids in each closed loop depending on the particular need for a certain circumstance. For example, one closed loop cycle of the exhaust turbine can use a working fluid with a low boiling point while another closed loop cycle may be using a working fluid with a higher boiling point. The third closed loop cycle of the exhaust turbine system may use a working fluid in a constant gaseous phase, if desired.

I claim:

1. In a turbine power plant having a closed loop steam turbine system and a closed loop exhaust turbine system;

a closed loop steam turbine system which comprises the combination of:

a steam turbine having a fluid inlet and fluid outlet mounted on a shaft;

a generator means operatively connected to said shaft;

a condenser having a fluid inlet and a fluid outlet and a cooling means between its inlet and outlet;

a pump having a fluid inlet and fluid outlet and a pressurizing and circulating means between its inlet and outlet, said pump mounted on a shaft of the exhaust turbine system;

a heater having a fluid inlet and fluid outlet which uses an external fuel source to superheat fluid flowing between its inlet and outlet;

a fluid conduit means operatively connecting the following in a closed loop cycle, the outlet of said heater to the inlet of said steam turbine, the outlet of said steam turbine to the inlet of said condenser, the outlet of said condenser to the inlet of said pump, the outlet of said pump to the inlet of said heater;

said fluid conduit means operatively connecting the outlet of said steam turbine to the inlet of said condenser is designed to provide exhaust heat energy to said exhaust turbine system as the working fluid flows from said steam turbine to said condenser;

said fluid conduit means operatively connecting the outlet of said pump to the inlet of said heater is designed to receive heat energy from said exhaust turbine system and from the hot exhaust of said steam turbine as the working fluid flows from said pump to said heater;

a closed loop exhaust turbine system which comprises the combination of:

a first, second, and third turbines each having a fluid inlet and outlet and each mounted on a common shaft;

a generator means operatively connected to said shaft;

a first, second, and third pump each having a fluid inlet and outlet, and a pressurizing and circulating means between said inlets and outlets all connected to said common shaft;

a first, second, and third condensers each having a fluid inlet and outlet and a cooling means between their inlets and outlets;

a first, second, and third heat exchangers each having a first fluid passageway arrangement having a fluid inlet and outlet at opposite ends and a second fluid passageway arrangement having a fluid inlet and outlet at opposite ends, wherein the fluid flow in said second passageway arrangement is opposite to the fluid flow in said first passageway arrangement allowing for a heat exchange relationship;

a fluid conduit means operatively connecting the following in a closed loop fluid cycle, the outlet of said first exhaust turbine to the inlet of said first fluid passageway arrangement of said first heat exchanger, the outlet of said first fluid passageway arrangement of said first heat exchanger to the inlet of said first condenser, the outlet of said first condenser to the inlet of said first pump, the outlet of said first pump to the inlet of said second fluid passageway arrangement of said first heat exchanger, the outlet of said second fluid passageway arrangement of said first heat exchanger to the inlet of said first exhaust turbine; said first exhaust turbine receiving heat energy to operate from the exhaust of said steam turbine system;

a fluid conduit means operatively connecting the following in a closed loop fluid cycle, the outlet of said second exhaust turbine to the inlet of said first fluid passageway arrangement of said second heat exchanger, the outlet of said first fluid passageway arrangement of said second heat exchanger to the inlet of said second condenser, the outlet of said second condenser to the inlet of said second pump, the outlet of said second pump to the inlet of said second fluid passageway arrangement of said second heat exchanger, the outlet of said second fluid passageway arrangement of said second heat exchanger to the inlet of said second exhaust turbine; said second exhaust turbine receiving heat energy to operate from the exhaust of said steam turbine system;

a fluid conduit means operatively connecting the following in a closed loop fluid cycle, the outlet of said third exhaust turbine to the inlet of said first fluid passageway of said third heat exchanger, the outlet of said first fluid passageway of said third heat exchanger to the inlet of said third condenser, the outlet of said third condenser to the inlet of said third pump, the outlet of third pump to the inlet of said second fluid passageway of said third heat exchanger, the outlet of said second fluid passageway of said third heat exchanger to the inlet of said third exhaust turbine, said third exhaust turbine receiving heat energy to operate from the exhaust of said steam turbine system.

2. A turbine power plant according to claim 1 in which an external energy source is used to drive said steam turbine system and the exhaust heat energy of said steam turbine system is used to drive the exhaust turbine system.

3. A turbine power plant system according to claim 1, in which the turbine blades in the rotor passageway of said steam turbine and said first, second, and third exhaust turbines are set at an angle which allows the blades to pull in the fluid at the turbine inlet and push out the fluid at the turbine outlet.

4. A turbine power plant system according to claim 1, in which each of the first and second fluid passageway arrangements of said first, second, and third heat exchangers each consist of a plurality of parallel passages for effective heat transfer.

5. A turbine power plant according to claim 1, in which each of said turbines is designed to allow a heat exchanger relationship between the individual closed loop cycles, said turbines having fluid conduits which pass outside of the rotor blades "tapering in" (decreasing in size) at the turbine inlet and "tapering out" (increasing in size) at the turbine outlet, wherein said turbines are designed to allow the working fluid to enter said blades continuously and leave said blades continuously as the working fluid flows from the turbine inlet to the turbine outlet.

* * * * *